US006312275B1

(12) United States Patent
Tortorella

(10) Patent No.: US 6,312,275 B1
(45) Date of Patent: Nov. 6, 2001

(54) ELECTROMAGNETICALLY LOCKING LATCH TO PREVENT CIRCUIT PACK REMOVAL

(75) Inventor: Michael Tortorella, Middletown, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/678,186

(22) Filed: Sep. 30, 2000

(51) Int. Cl.[7] ..... H01R 4/50
(52) U.S. Cl. ..... 439/341; 361/801; 361/759
(58) Field of Search ..... 439/157, 159, 439/160, 372; 361/754, 801, 798, 759; 200/50 R, 535

(56) References Cited

U.S. PATENT DOCUMENTS 4,434,635 * 3/1984 Borgato ..... 70/279
4,472,617 * 9/1984 Ueda et al. ..... 219/10.55
4,596,907 * 6/1986 LaGreo et al. ..... 200/50
5,191,970 * 3/1993 Brockway et al. ..... 200/335
5,997,326 * 12/1999 Koradia et al. ..... 439/160
6,094,353 * 7/2000 Koerber et al. ..... 361/754
6,115,246 * 9/2000 Ohnishi ..... 361/686
6,172,880 * 1/2001 Petitpierre et al. ..... 361/801
6,185,106 * 2/2001 Mueller ..... 361/798
6,185,773 * 2/2001 Goedde ..... 7/540

* cited by examiner

*Primary Examiner*—Gary Paumen
*Assistant Examiner*—Phuongchi Nguyen
(74) *Attorney, Agent, or Firm*—Woodbridge & Associates, P.C.; Richard C. Woodbridge

(57) ABSTRACT

An electronically controlled locking apparatus uses a latch, a latch locking clip and a solenoid to lock a circuit pack face plate to an equipment chassis based on activity in the circuit pack. The latch is pivoted so that one end engages the chassis while the other end is locked by the latch locking clip. The solenoid and plunger are deployed so that the plunger can selectively prevent the latch locking clip from disengaging the latch, thereby preventing the latch from being opened. Circuitry for indicating activity on the circuit pack controls the solenoid and plunger, thereby preventing the removal of an active circuit pack. Additional override circuitry permits an operator to override the solenoid should the circuit pack need to be removed in emergencies.

10 Claims, 6 Drawing Sheets

ELECTROMAGNETICALLY LOCKING LATCH TO PREVENT CIRCUIT PACK REMOVAL

BACKGROUND OF THE INVENTION

1. Field of the Invention

The invention relates to the physical infrastructure for mounting electronic circuit boards or packs in computer or communications equipment.

2. Description of Related Art

Modem telecommunications equipment such as the telephone switch and the network router often employ multiple circuit boards or packs plugged into a backplane. The multiple circuit packs are arranged in rows and are mounted to a chassis or cabinet using a common locking system of pivoting plastic latches located on the face plate of each circuit pack.

A typical prior art locking system is illustrated in FIGS. 1A and 1B. The plastic latches are pivoted, with one end having a hook for engaging a chassis while the other end has an aperture that engages a latch locking clip mounted on the circuit board or pack. When each latch is in the open position, the aperture is released from the latch locking clip, which in turn disengages the latch from the chassis. Each latch is "closed" when the latch swings down so that the hook catches the chassis and the latch locking clip engages the aperture, securing the arm and thus the circuit pack. The user thus has a fairly easy way of inserting and removing circuit packs for the given equipment cabinet.

One drawback of the system, however, stems from an operator opening up the latches and removing the circuit pack when the circuit pack is active, because nothing in the system prevents the operator from disengaging the latch locking clip from the aperture and opening the latch while the circuit pack is active. Accidentally removing an active circuit pack from a piece of electronic equipment usually disables the equipment and in certain cases can also damage the equipment. The probability for accidental removal increases in cases where the electronic appliance has two identical circuit pack configurations, where one group of circuit packs serves as a back-up to the other. Operators may understandably remove an active circuit pack by mistake, thinking it is an inactive backup used for redundancy purposes.

The impact of accidental removals can be quite substantial, because equipment requiring redundant circuit packs tends to be of a critical nature, such as telephone switches. Accidentally removing an active circuit pack from such equipment could interrupt telephone or networking service and the equipment may not be easily reset to working order. Thus, it is important to prevent the accidental removal of circuit packs, particularly when the circuit packs are deployed redundantly.

SUMMARY OF THE INVENTION

Briefly described, the invention comprises a latch and flexible latch locking clip for a circuit pack where a solenoid and plunger are mounted so that the plunger can restrict movement of the latch locking clip, preventing it from being opened. The latch is mounted on the circuit pack face plate so that it can be pivoted to either engage or disengage the circuit pack face plate from a mounting chassis. The latch includes an aperture for engaging a flexible latch locking clip that holds the latch in a closed position.

A solenoid and plunger are mounted on the circuit pack to control use of the latch locking clip. The plunger is either extended to push against the latch locking clip to prevent motion or retracted to allow the latch locking clip to be moved. The solenoid can thus be used to control the latch locking clip, thereby preventing the user from accidentally opening the latch locking clip, disengaging the latch, and removing the circuit pack from the chassis. Prior art circuits for indicating activity on the circuit pack ultimately control the solenoids, so that this circuit locks the latch locking clip when the circuit pack is active but releases the latch locking clip once the circuit pack is no longer active.

The latches are often installed one pair per circuit pack, so the solenoids and plungers would similarly be deployed in pairs, where both solenoids could be controlled from a single activity control circuit. One additional feature of the invention includes an override circuit that allows the solenoids and plungers to be manually deactivated, permitting an operator to remove the circuit pack even if the circuit pack is indicated as being active or "on".

DETAILED DESCRIPTION OF THE INVENTION

An apparatus for preventing accidentally removing a circuit pack is disclosed. During the course of this description, like numbers will be used to identify like elements according to the different views which illustrate the invention.

Figure 1A:
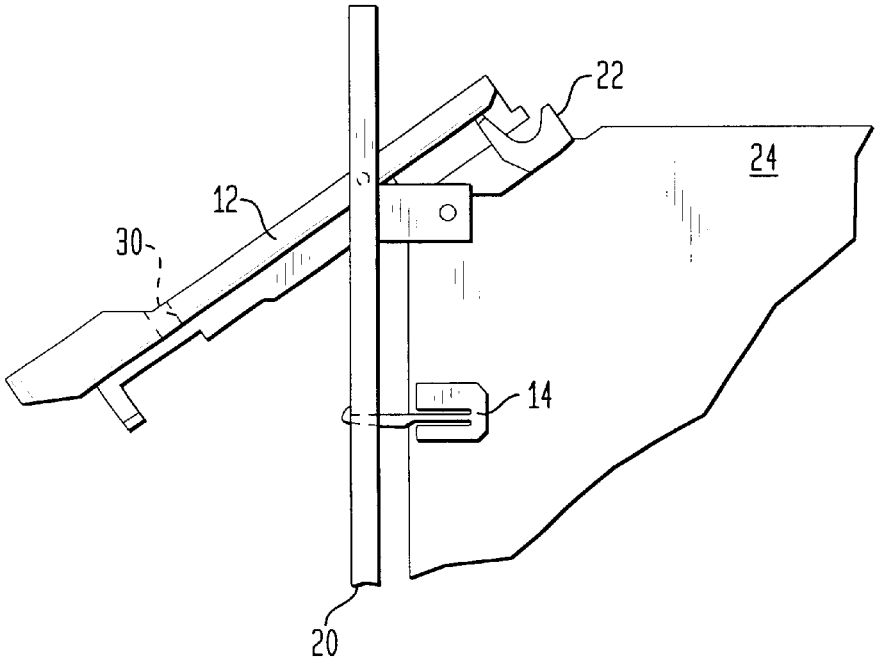
FIG. 1A (PRIOR ART)
FIG. 1A is a side view for a circuit pack showing a face plate and a prior art latch and latch locking clip.
Figure 1B:
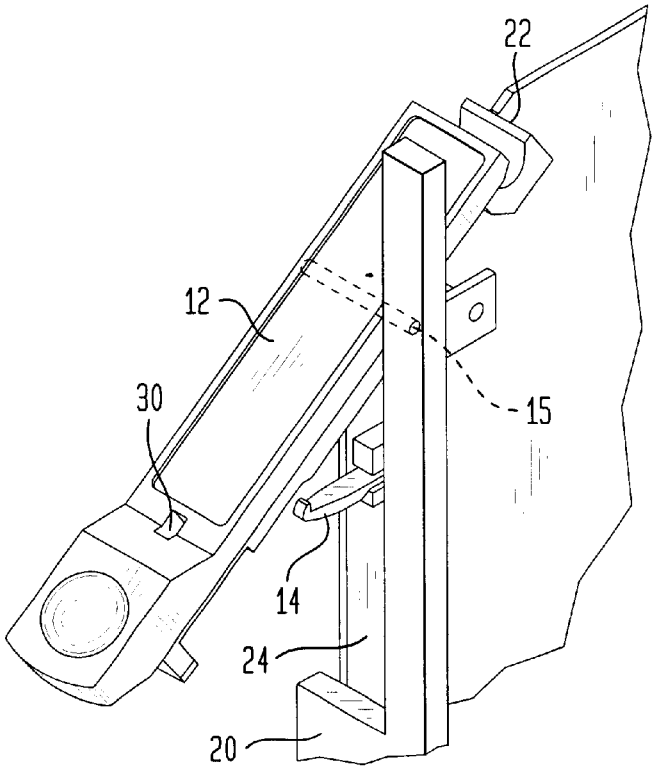
FIG. 1B (PRIOR ART)
FIG. 1B is a front view of the circuit pack face plate with a prior art latch and latch locking clip.
Figure 4A:
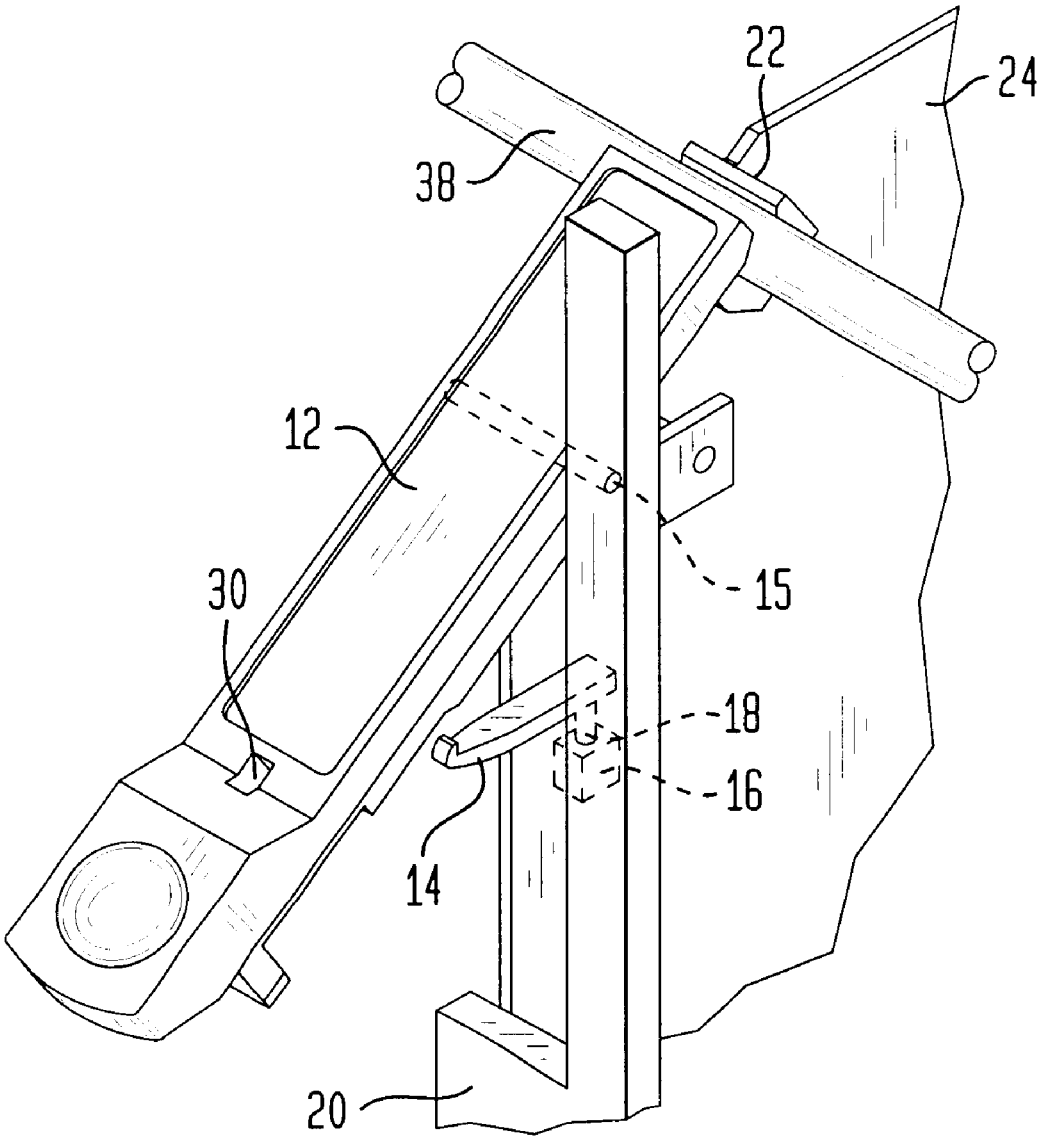
FIG. 4A is an isometric schematic view of the latch in the open position.
Figure 4B:
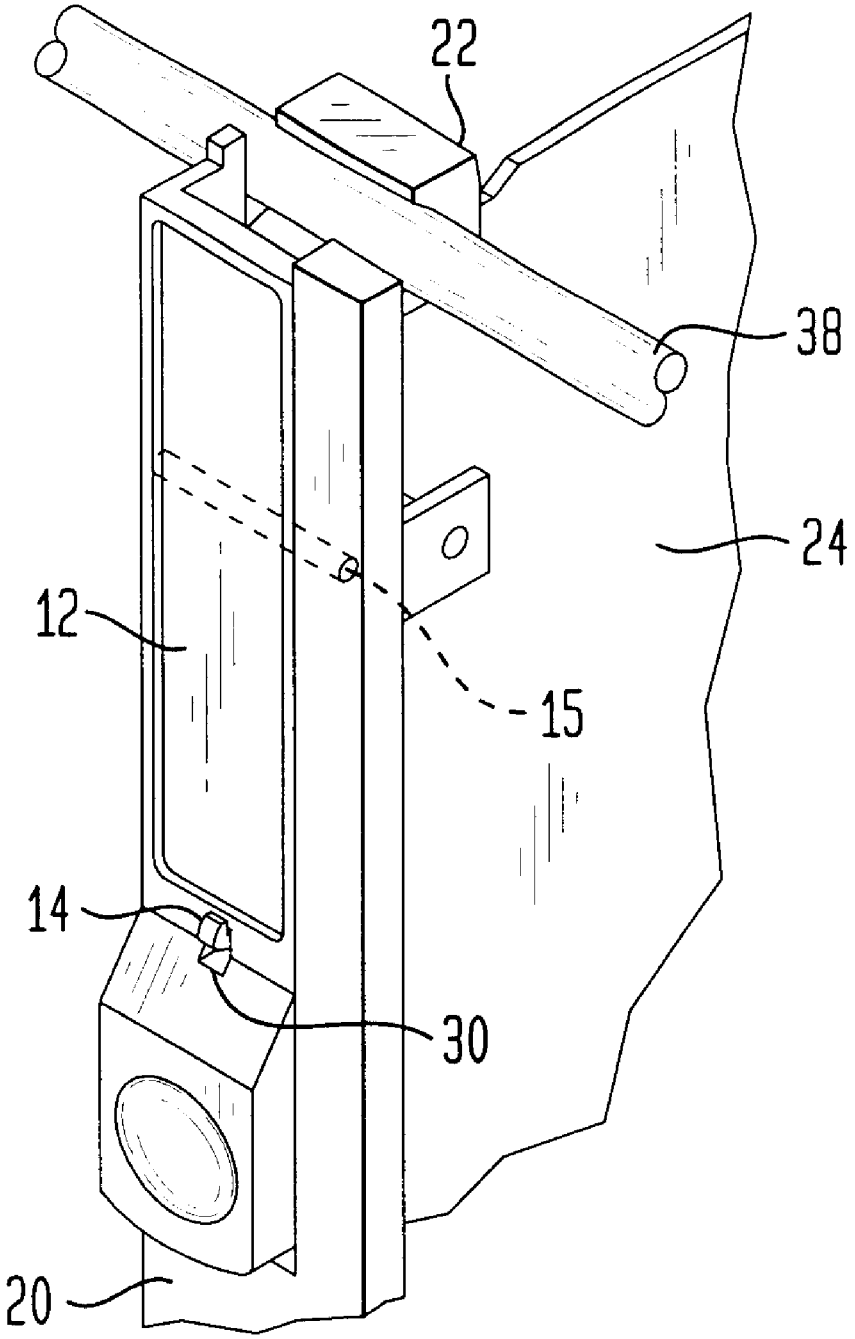
FIG. 4B is an isometric schematic view of the latch in the closed position.

One common prior art locking system for a circuit pack as illustrated in FIGS. 1A and 1B comprises a pair of plastic latches 12 that lock the circuit pack 24 into place while also permitting the pack to be easily removed. Each plastic latch 12 has one end with a means 22 for engaging a chassis 38 or other mounting mechanism of the electronic cabinet in which the circuit pack will be housed. The latch 12 is attached to the face plate 20 via a pivot 15, so that the latch 12 swings. The other end of the plastic latch 12 contains an aperture 30 for receiving a latch locking clip 14 that is mounted on the circuit pack 24 (see FIGS. 1B, 4A and 4B). The latch 12 is opened by disengaging the latch locking clip 14 from the aperture 30, pivoting the latch 12 and releasing the engaging means 22 from the chassis 38. Similarly, the latch 12 is closed by moving the latch 12 back until the chassis engaging means 22 engage the chassis 38 and engaging the latch locking clip 14 to the aperture 30, securing the face plate 20 to the chassis 38. The latch locking clip 14 itself is of a cantilever design and is flexible in order to facilitate locking and unlocking from the latch 12. Thus, the latches 12 provide the user of the circuit pack 24 with a fairly straightforward means for adding and removing the circuit pack 24.

Figure 2:
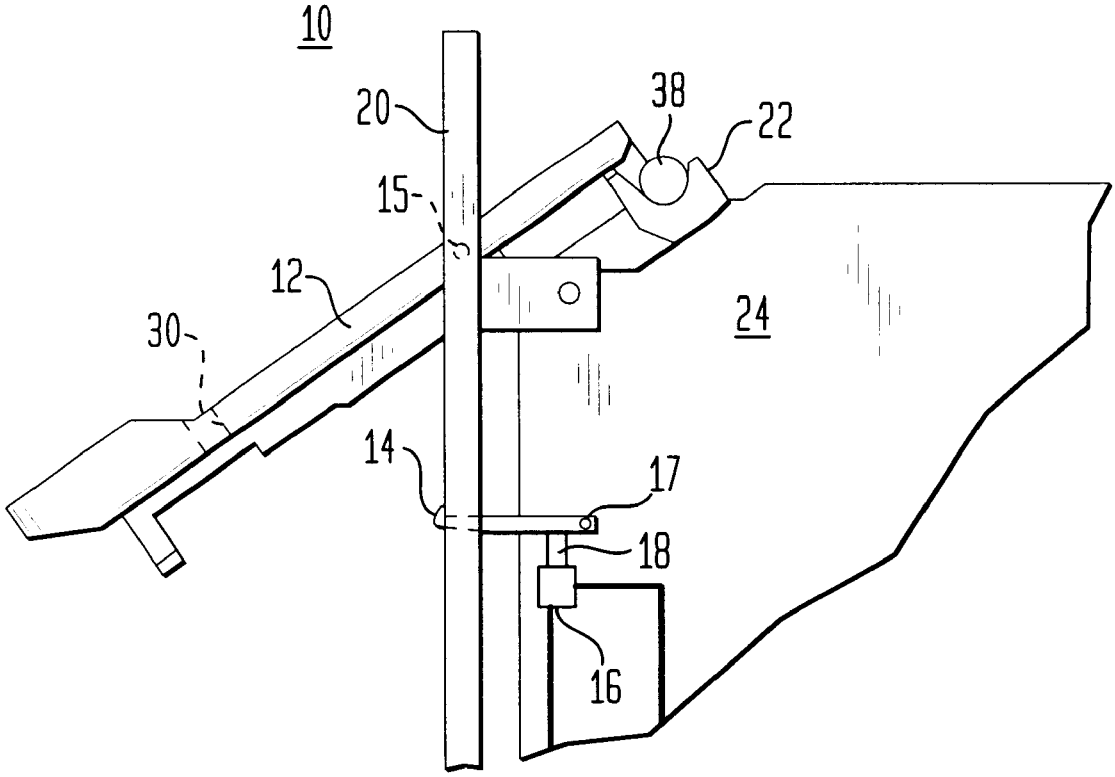
FIG. 2 is a detailed side view of the preferred embodiment of the invention, including latch, solenoid, plunger and latch locking clip.
Figure 3:
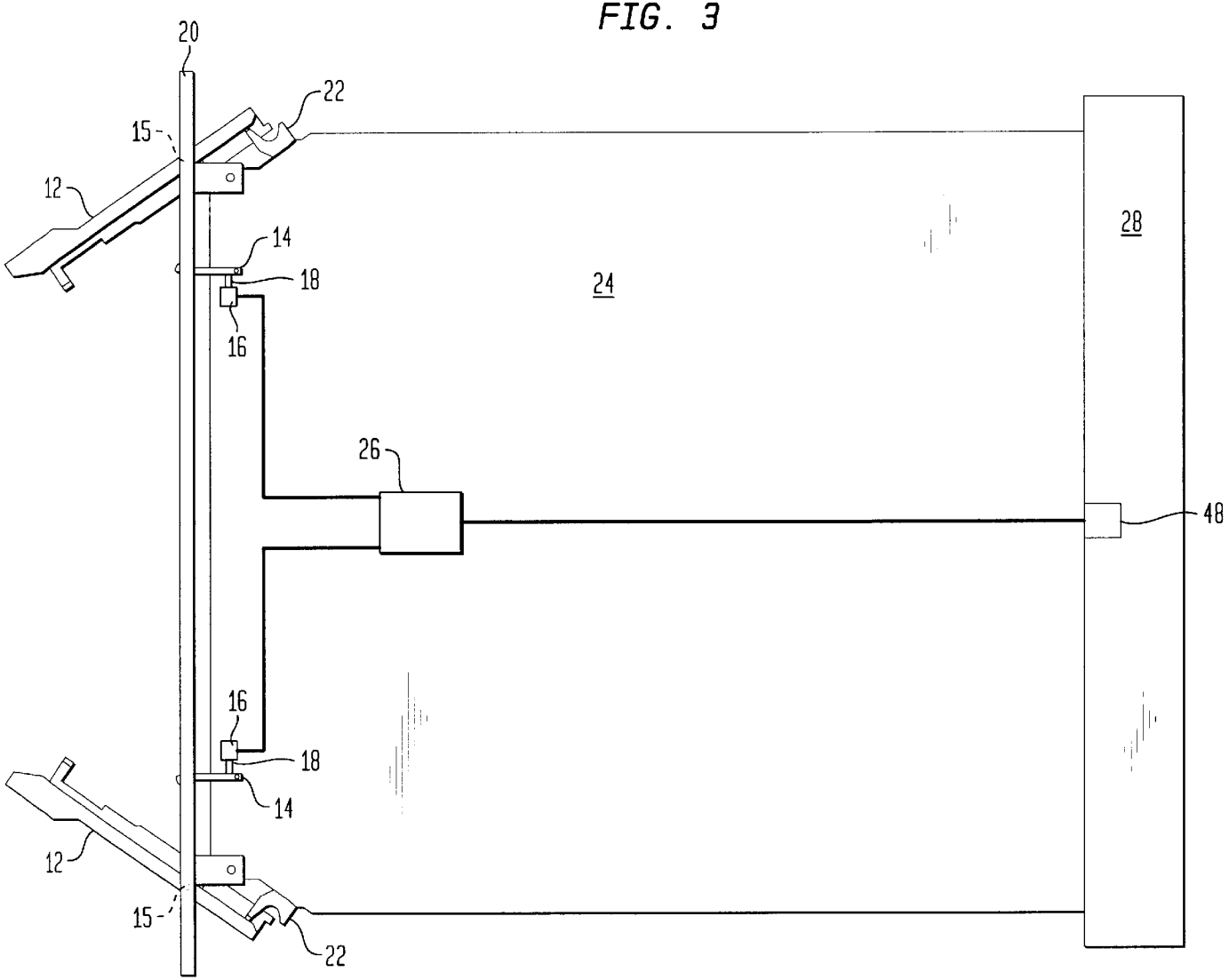
FIG. 3 illustrates a circuit pack with two latches and also shows the connection between the solenoids and the control circuit.

Existing prior art latches 12 by themselves, however, will not prevent a user from accidentally removing a circuit pack 24 while the pack is in use. To prevent accidental removal, the present invention employs a solenoid 16 and a control circuit 26 to lock the latch locking clip 14 at times when the circuit pack 24 is active, as shown in FIG. 2. The solenoid 16 has attached to it a plunger 18 positioned so that the plunger 18 can selectively restrict the motion of the latch locking clip 14, thereby preventing the clip 14 from disengaging from the aperture 30. Preventing the latch locking clip 14 from disengaging the aperture 30 in turn prevents the latch 12 from opening up and disengaging from the mounting chassis 38 (see FIGS. 2, 4A–4B). In the preferred embodiment the solenoid 16 may be implemented so that upon activation the plunger 18 extends outward and blocks the latch locking clip 14 from moving.

Figure 5:
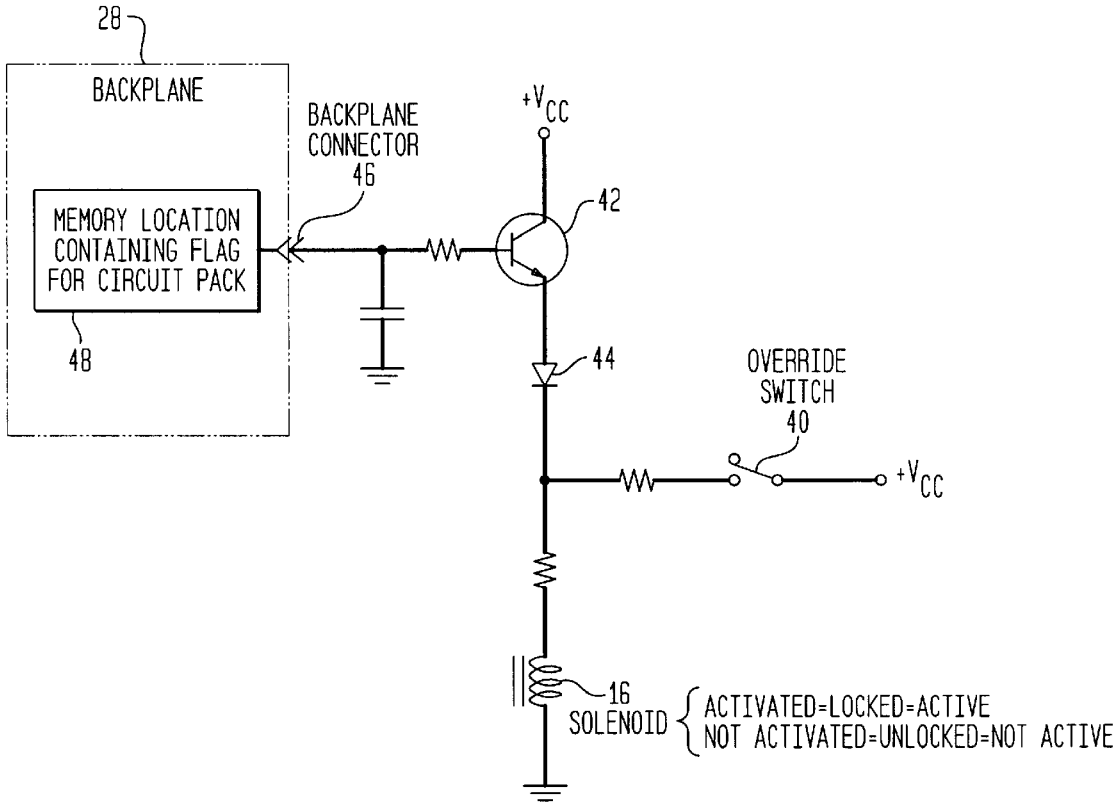
FIG. 5 is an electronic schematic that illustrates the control and override circuitry.

In the preferred embodiment, an electronic control circuit 26 triggers the solenoid 16 and plunger 18 to restrict the latch locking clip 14 based on activity detected in the circuit pack 24. Prior art electronic circuitry for monitoring redundant circuit packs already have a signal on the backplane 28 that indicating that the circuit pack is in use. Referring to FIG. 5, the solenoid 16 is connected through a transistor 42, a diode 44 and a backplane connector 46 to a memory location 48 on the backplane 28, where the memory location 48 contains a binary flag indicating whether the circuit pack 24 is active, using reverse digital logic. When the circuit pack is active, the memory location 48 is at logical 0 (low), so that current flows through the solenoid 16, pushing the plunger out and preventing the latch locking clip 14 from being opened. Conversely, when the circuit pack is inactive, the memory location 46 is at logical 1 (high), deactivating the solenoid 16, which allows the latch locking clip 14 to move and thus to be disengaged from the latch 12. Alternately, the solenoid 16 may be implemented so that the plunger 18 is retracted upon solenoid activation by programming the memory location to be logical 0 (low) when the circuit pack is inactive and logical 1 (high) when the circuit pack is active, thereby permitting the latch locking clip 14 to be disengaged from the latch aperture 30.

Because a circuit pack face plate 20 is usually mounted with two latches 12, each circuit pack has two latch locking clips 14, one for each latch 12. Each latch locking clip 14 thus has a corresponding solenoid 16 and plunger 18 for restricting the latch locking clip 14. As both latches 12 need to be locked to secure the circuit pack face plate onto the mounting chassis 38, the two solenoids 16 can be controlled by the same control circuit 26, thereby synchronizing the locking of the two latches 12. Alternately, the two solenoids 16 may be connected through two different control circuits 26 to a single memory location 48, where each control circuit contains a separate transistor and diode.

In a further embodiment of the invention, an override circuit 34 allows the equipment user to open the latches 12 and disengage the circuit pack from the chassis even if the pack is indicated as active. In one embodiment of the override feature, an override switch 40 is added to the control circuit 26 as shown in FIG. 5. When the switch 40 is thrown, the voltage on the other side of the diode 42 causes the solenoid 16 to be deactivated, preventing the plungers 18 from restricting the latch locking clips 14. The override switch 40 could alternately be a gate that is triggered by a power failure detection circuit. In either implementation, the override switch or gate permits the operator to remove the circuit pack 24 even if the circuit pack 24 is active or appears active to the activity detection circuit, but may really not be. In this way, the operator has the flexibility to remove the circuit pack 24 in case of emergency.

While the invention has been described with reference to the preferred embodiment thereof, it will be appreciated by those of ordinary skill in the art that modifications can be made to the structure and elements of the invention without departing from the spirit and scope of the invention as a whole.

I claim:

1. A circuit pack locking apparatus, for use in a circuit pack having a face plate and mounted on a chassis, said apparatus comprising the following:

(a) a latch having one end with;
  (i) a chassis engaging means for engaging said chassis;
  (ii) a pivot means to hold said latch to a face plate of so that said latch may pivot between an open position and a closed position wherein said closed position engages said chassis and holds said circuit pack on to said chassis and said open position disengages said chassis engaging means;

and said latch having a second end with;
  (iii) an aperture capable of receiving a latch locking means;

(b) latch locking means located on said circuit pack for engaging and holding said latch in said closed position, said latch locking means comprising
  (i) a latch locking clip fastened to said circuit pack said latch locking clip being freely flexible on one end and fixed on the other end; and, (c) restricting means for selectively restricting said latch locking means in a position so that said latch locking means cannot be disengaged from said latch, said restricting means comprising;
  (i) a solenoid with a plunger, wherein said plunger selectively engages said latch locking clip, thereby preventing said latch locking clip from disengaging from said aperture of said latch.

2. The apparatus of claim 1 wherein said solenoid plunger pushes against said latch locking clip when said solenoid is active thereby restricting motion of said latch locking clip.

3. The apparatus of claim 1 wherein said solenoid plunger moves away from said latch locking means when said solenoid is active thereby releasing the latch locking clip for motion.

4. The apparatus of claim 1 further comprising:

an electronic control circuit connected to said solenoid for controlling the movement of said plunger.

5. The apparatus of claim 4 wherein said electronic control circuit is connected to means for detecting circuit pack activity, so that said solenoid is controlled by the presence or absence of activity on said circuit pack.

6. The apparatus of claim 4 wherein said electronic control circuit further comprises an override means for overriding said electronic control circuit, thereby deactivating said solenoid in the event that latching means need to be opened even if the electronic control circuit would otherwise the solenoid to lock said retaining mechanism.

7. The apparatus of claim 6 wherein said override means further comprises an override circuit.

8. The apparatus of claim 7 wherein said override circuit is controlled by an operator switch.

9. The apparatus of claim 7 wherein said override circuit is activated upon a power failure.

10. The apparatus of claim 1 wherein said circuit pack includes more than one latch, latch locking clip and restriction means.

* * * * *